US006442989B1

(12) United States Patent
Takeda et al.

(10) Patent No.: US 6,442,989 B1
(45) Date of Patent: Sep. 3, 2002

(54) WIRE SIZING ROLLING METHOD

(75) Inventors: Ryo Takeda; Takao Ogawa; Tomoyasu Sakurai, all of Okayama (JP)

(73) Assignee: Kawasaki Steel Corporation (JP)

( * ) Notice: Subject to any disclaimer, the term of this patent is extended or adjusted under 35 U.S.C. 154(b) by 0 days.

(21) Appl. No.: 09/807,488

(22) PCT Filed: Aug. 3, 2000

(86) PCT No.: PCT/JP00/05203

§ 371 (c)(1),
(2), (4) Date: Apr. 27, 2001

(87) PCT Pub. No.: WO01/14074

PCT Pub. Date: Mar. 1, 2001

(30) Foreign Application Priority Data

Aug. 19, 1999 (JP) ..... 11-233222

(51) Int. Cl.[7] ..... B21B 13/10

(52) U.S. Cl. ..... 72/224; 72/227; 72/235; 72/250

(58) Field of Search ..... 72/224, 226, 227, 72/234, 235, 250, 366.2

(56) References Cited

U.S. PATENT DOCUMENTS 4,685,320 A * 8/1987 Yanazawa et al. ..... 72/235
5,363,682 A * 11/1994 Takeda et al. ..... 72/224

FOREIGN PATENT DOCUMENTS

| | | | | |
|---|---|---|---|---|
| JP | 58-187203 | * | 11/1983 | ..... 72/235 |
| JP | 5-38501 | * | 2/1993 | ..... 72/235 |
| JP | 5-212403 | * | 8/1993 | ..... 72/235 |

* cited by examiner

*Primary Examiner*—Ed Tolan
(74) *Attorney, Agent, or Firm*—Schnader Harrison Segal & Lewis LLP

(57) ABSTRACT

In a sizing rolling method carried out by installing at least 3 sets of 4-roll rolling mills in series, a central angle $\theta_1$ of the perfect circle forming section of each rolling roll in a first path is set to less than 15°. The central angle $\theta_3$ is set to at least 45° in a third path and the central angle $\theta_2$ is set to at least 30° in a second path B. The groove of each rolling roll is arranged such that each escape section is composed of the tangential line of an arc formed by the perfect circle forming section. A roller guide having four guide rollers is installed on the inlet side of the second path and the free surface of a workpiece is held and guided by the guide rollers. An angle $\alpha$ of the V-shaped groove of each guide roller is set similar to the angle $(90°+\theta_1)$ between straight lines forming the escape section of the adjacent rolling rolls in the first path. With this technology, even if a wire has a diameter of 7.0 mm or less, an excellent surface property can be obtained while securing a large size free range.

6 Claims, 4 Drawing Sheets

WIRE SIZING ROLLING METHOD

This application is a 35 USC 371 of PCT/JP00/05203 filed Aug. 3, 2000.

TECHNICAL FIELD

The present invention relates to a method of sizing rolling a wire by a 4-roll rolling mill.

BACKGROUND ART

A conventional example of a sizing rolling method using a 4-roll rolling mill (rolling method of manufacturing a bar and wire having a different diameter using the same rolling rolls and changing a gap therebetween) is disclosed in, for example, Japanese Examined Patent Application Publication No. 3-6481.

In this method, two sets of 4-roll rolling mills, which incline a rolling direction by 45° each other, are installed in series along a rolling line. Each of the rolling rolls used here includes a groove formed on the outer circumferential surface thereof and the groove is composed of an arc-shaped perfect circle forming section and a suitable escape section. Further, the publication describes it is preferable that the central angle of the perfect circle forming section of the groove be as small as possible and that an amount of escape (the angle between the escape section and the perfect circle forming section) be as large as possible in the range in which no flaw is caused in order to increase a size range (hereinafter, referred to as "size free range") of products which can be sizing rolled by the same rolls within an allowable range of dimensional error.

In contrast, the applicant proposed a sizing rolling mill capable of increasing the size free range in consideration of bitten-out and falling-down which are a problem in actual rolling carried out by 4 rolls while suppressing the occurrence of the problem (refer to Japanese Unexamined Patent Application Publication No. 9-225502). In the proposal, at least three sets of 4-roll rolling mills are installed and the central angles of the perfect circle forming sections of the grooves of the respective rolling rolls are set to at least 15° in a first path, to at least 45° in a final path and to at least 30° in an intermediate path (second path).

"Bitten-out" used here means that a workpiece 7 is protruded form the space (caliber) surrounded by the outer circumferential surfaces of 4 rolling rolls 50 as shown in FIG. 5. When the center of the workpiece 7 does not pass through the center of the caliber in rolling, the bitten-out is liable to be arisen. When an amount of bitten-out is large, a bitten-out portion 75 is folded in the caliber in the next path and made to a folded flaw.

Further, "falling-down" means that the workpiece 7 is rotated between paths as shown in FIG. 6. A degree of falling-down is represented by the angle (falling-down angle) $\gamma$ between the line $L_1$ showing the central position of one of the rolling rolls 50 in the width direction thereof and the line $L_2$ showing the position of the workpiece 7 which is to be located at the central position of the rolling roll 50 in the width direction thereof in the path. When an amount of falling-down is large, a faulty product is made due to a surface flaw and a bent flaw.

In the sizing rolling mill disclosed in Japanese Unexamined Patent Application Publication No. 9-225502, however, it has been found that there is a tendency that is liable to be arisen in a second path particularly in a wire having a small diameter (for example, a wire having a diameter of 7 mm or less) and there is a possibility that a bent flaw is caused in a third path accordingly.

An object of the present invention is to obtain an excellent surface property in a sizing rolling method which is carried out by at least 3 sets of 4-roll rolling mills installed in series in a wire particularly having a small diameter.

To solve the above problem, an invention according to claim 1 provides a wire sizing rolling method which is characterized by comprising the steps of installing at least 3 sets of 4-roll rolling mills in series with each rolling mill having 2 pairs of 4 rolling rolls each having a groove formed on an outer circumferential surface and composed of an arc-shaped perfect circle forming section and escape sections and setting central angles of the perfect circle forming sections of the rolling rolls to less than 15° in the first path of final three paths, to at least 30° in the second path thereof, and to at least 45° in the third path thereof; and installing a roller guide on the inlet side of the second path and introducing a workpiece to the second path while holding and guiding the workpiece by the guide rollers of the roller guide such that the surface of the workpiece which was not rolled in the first path is located at the central portions of the guide rollers.

DISCLOSURE OF INVENTION

According to this method, since the central angle of the perfect circle forming section of each rolling roll in the first path of the final three paths is set to less than 15° as well as the free surface of the workpiece is held and guided by the guide rollers of the roller guide installed on the inlet side of the second path, the holding/guiding capability of the guide rollers of the roller guide for the workpiece can be improved as compared with the case in which the central angle of the perfect circle forming section of each rolling roll in the first path is set to at least 15°, whereby it is made difficult for falling-down to occur in the second path. Further, in addition to the above, since the central angle of the perfect circle forming section of each rolling roll is set to at least 30° in the second path of the final three paths and to at least 45 in the final path, an excellent surface property can be obtained in a resulting product.

An invention of claim 2 is characterized in the wire sizing rolling method according to claim 1 such that the escape section of each rolling roll in the first path is formed by straight lines, the straight lines act as tangential lines to both the ends of the arc forming the perfect circle forming section, a V-shaped groove for holding and guiding the workpiece is formed on the outer circumferential surface of each guide roller of the roller guide installed on the inlet side of the second path, and an angle of the V-shaped groove is set similar to the angle between the straight lines forming an escape section between the adjacent rolling rolls in the first path.

An invention according to claim 3 provides a wire sizing rolling method of sizing rolling a wire by a 4-roll rolling mill each having two pairs of 4 rolling rolls, the method being characterized by comprising the steps of installing at least 3 sets of the 4-roll rolling mills in series, using flat rolls as rolling rolls each having an outer circumferential surface on which no groove is formed in the first path of final three paths, and using rolls as rolling rolls each having an outer circumferential surface having a groove composed of an arc-shaped perfect circle forming section and escape sections in the second and subsequent paths thereof with the central angles of the perfect circle forming sections of the respective rolling rolls set to at least 30° in the second path and to at least 45° in the third path; and installing a roller guide on the inlet side of the second path and introducing a workpiece to the second path while holding and guiding the workpiece by the guide rollers of the roller guide such that the surface of the workpiece which was not rolled in the first path is located at the central portions of the guide rollers.

In the 4-roll rolling mill, since one rolling roll receives the cross section of the workpiece in the range of 90°, when an arc-shaped groove is formed on the outer circumferential surface of each rolling roll, the central angle of the arc is 90° or less. Then, when the central angle of the arc is 0°, the rolling roll is arranged as the flat roll whose outer circumferential surface has no groove. Accordingly, the method of claim 3 corresponds to the case in which the central angle ($\theta_1$) of the perfect circle forming section of each rolling roll in the first path is set to 0°.

That is, in the method of claim 1, since it is set forth as a premise that the grove of each rolling roll is composed of a perfect circle forming section and escape sections also in the first path, it is interpreted that the method, in which the flat roll of $\theta_1=0$ is used as each rolling roll in the first path, is not included in the method of claim 1. However, actually, an effect of making the occurrence of falling-down difficult is higher in the case of $\theta_1=0$ than the case of $0<\theta_1<15°$, claim 3 is provided independently of claim 1.

An invention of claim 4 is characterized in the wire sizing rolling method according to claim 3 such that a V-shaped groove for holding and guiding the workpiece is formed on the outer circumferential surface of each guide roller of the roller guide installed on the inlet side of the second path, and an angle of the V-shaped groove is set to 90°.

Figure 1A:
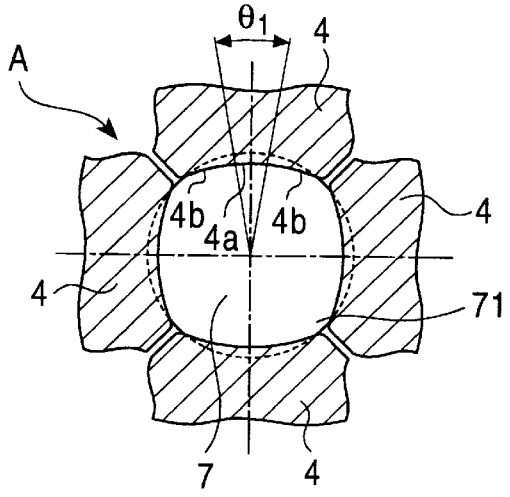
FIG. 1 is a view explaining a sizing rolling method corresponding to an embodiment of the present invention, wherein (a) shows rolling rolls of a first path A, (b) shows the guide rollers of a roller guide installed at the inlet side of a second path B, (c) shows rolling rolls in the second path B, and (d) shows rolling rolls in a third path C, respectively.
Figure 1B:
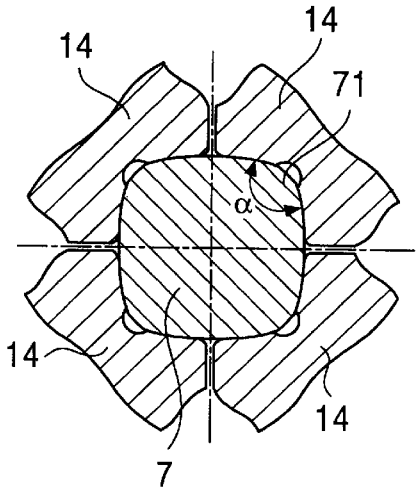
Figure 1C:
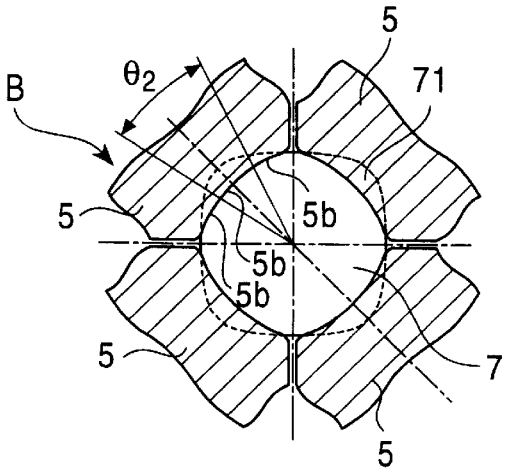
Figure 1D:
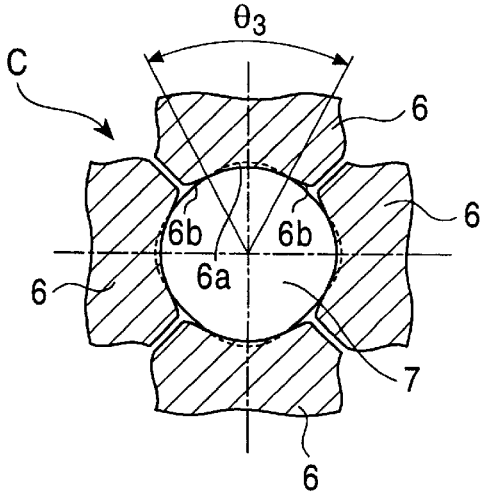

REFERENCE NUMERALS rolling roll in first path
rolling roll in second path
rolling roll in third path
5*a*, 6*a* perfect circle forming section of groove
5*b*, 6*b* escape section of groove
7 workpiece
71 free surface
14 guide roller
4*a* V-shaped groove
14*b* escape groove
41 tangential lines to both the ends of arc acting perfect circle forming section
$\alpha$ angle of V-shaped groove
$\beta$ angle between straight lines forming escape section
A first path
B second path
C third path
$\theta_1$ central angle of perfect circle forming section of rolling roll in first path
$\theta_2$ central angle of perfect circle forming section of rolling roll in second path
$\theta_3$ central angle of perfect circle forming section of rolling roll in third path

BEST MODE FOR CARRYING OUT THE INVENTION

An embodiment of the present invention will be described below.

FIG. 1 is a view explaining a sizing rolling method corresponding to the embodiment of the present invention, wherein (a) shows rolling rolls of a first path A, (b) shows the guide rollers of a roller guide installed at the inlet side of a second path, (c) shows rolling rolls in the second path B, and (d) shows rolling rolls in a third path C, respectively.

In the embodiment, three sets of 4-roll rolling mills are installed in series along a path line. The respective 4-roll rolling mills include 2 pairs of 4 rolling rolls 4, 5 and 6 radially disposed thereto, respectively. Grooves are formed on the outer circumferential surfaces of the respective rolling rolls 4–6 and composed of arc-shaped perfect circle forming sections 4*a*, 5*a*, 6*a* formed at the central portions of the rolling rolls and escape sections 4*b*, 5*b*, 6*b* formed on the right and left sides thereof.

Figure 2:
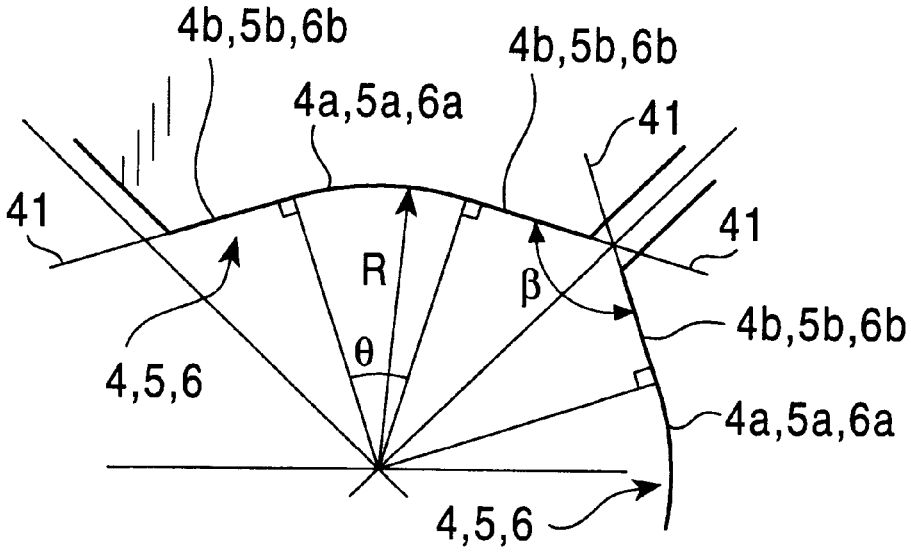
FIG. 2 is a view explaining a shape of the groove of the rolling rolls used in embodiment.

FIG. 2 shows the shapes of the grooves of the respective rolling rolls 4–6. In the respective rolling rolls 4–6, the escape sections 4*b*–6*b* of the grooves are formed by straight lines which act as tangential lines 41 with respect to both the ends of the arcs which form the perfect circle forming sections 4*a*–6*a*. That is, in the grooves, amounts of escape of the escape sections 4*b*–6*b* are set to 90°. Further, the arcs acting as the perfect circle forming sections 4*a*–6*a* of the grooves have a radius R which is set so as to be approximately the same as the radius of a workpiece 7 at the time it is introduced into respective paths. That is, the workpiece 7 has been rolled to have an approximately circular sectional shape before it is introduced into the first path A.

As shown in FIG. 1(*a*), the 4-roll rolling mill for the first path A is arranged such that the two pairs of the rolling rolls have rolling directions set in a vertical direction and a horizontal direction, respectively. Further, the perfect circle forming section 4*a* constituting the groove of each rolling roll 4 has a central angle $\theta_1$ set to less than 15°.

As shown in FIG. 1(*b*), the roller guide is installed at the inlet side of the second path to hold the workpiece 7 by the 4 guide rollers 14. The workpiece 7 is introduced to the second path while the surface (free surface) 71 thereof, which was not rolled in the first path, is held by the guide rollers 14 of the roller guide.

Figure 3:
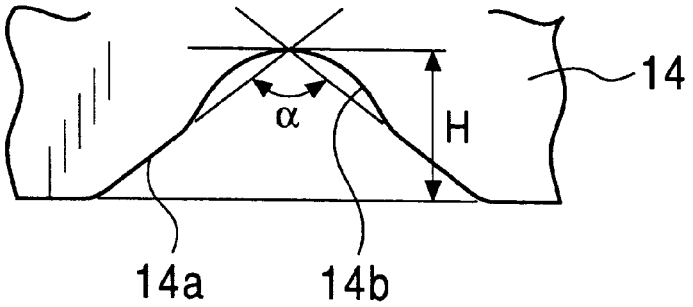
FIG. 3 is a view showing a shape of the V-shaped groove formed on the outer circumferential surface of the guide rollers of the roll guide used in the embodiment.

As shown in FIG. 3, each of the guide rollers 14 has a V-shaped groove 14*a* formed on the outer circumferential surface thereof and the surface of the V-shaped groove 14*a* acts as a holding/guiding surface of the workpiece 7. An escape groove 14*b* is formed on the bottom (central portion in the rotational axis direction of the guide roller 14) of the V-shaped groove 14*a*. Note that a depth H of the V-shaped groove 14*a* is set to a proper dimension in accordance with a diameter of the workpiece.

Then, an angle $\alpha$ of the V-shaped groove 14*a* of each guide roller 14 is set similar to the angle $\beta$ of FIG. 2. The angle β is the angle between the straight lines (the above-mentioned tangential lines 41) which form the escape section 4*b* between the adjacent rolling rolls 4 in the first path. Then, a relationship between the angle β and the central angle θ of each of the perfect circle forming sections 4*a*–6*a* of the rolling rolls is set to β=θ+90°, and a smaller angle θ results in a smaller angle β.

Further, the guide rollers 14 are disposed such that the surface (free surface) 71 of the workpiece 7 which is not rolled in the first path is held by the bottoms of the V-shaped grooves 14*a*.

Accordingly, since the angle a of the V-shaped groove 14*a* of each guide roller 14, which is set similar to the angle β of the first path, is reduced by setting the central angle $\theta_1$ of the perfect circle forming section 4*a* of each rolling roll 4 in the first path to a small value of less than 15°, the workpiece 7 can firmly be held even if its diameter is small. As a result, it is made difficult for falling-down to be caused in the workpiece 7 in the second path.

The roller guide may be arranged in any fashion so long as the angle of the V-shaped groove 14*a* of each guide roller 14 is set similar to the above angle β and the surface (free surface) 71 of the workpiece 7 which is not rolled in the first path is held and guided by the roller guide. An example of the guide roller arranged as described above is exemplified in Japanese Unexamined Patent Application Publication No. 8-229609.

As shown in FIG. 1(*c*), the 4-roll rolling mill for the second path (path prior to the final path) is arranged such that the two pairs of the rolling rolls 5 thereof have rolling directions set in a direction inclined 45° from a horizontal direction, respectively. Further, the perfect circle forming section 5*a* constituting the groove of each rolling roll 5 has a central angle $\theta_2$ set to at least 30°.

As shown in FIG. 1(*d*), the 4-roll rolling mill for the third path (final path) is arranged such that the two pairs of the rolling rolls 6 thereof have rolling directions set in a vertical direction and a horizontal direction, respectively. Further, the perfect circle forming section 6*a* constituting the groove of each rolling roll has a central angle $\theta_3$ set to at least 45°.

Next, rolling was carried out by the above-mentioned rolling mill under the following conditions and a relationship between a diameter of a product (diameter of a wire just after it left the third path) and a ratio of occurrence of falling-down in the second path was examined.

The central angle $\theta_1$ of the perfect circle forming section 4*a* of each rolling roll 4 in the first path was changed to 0°, 12°, 15°, and 18°. That is, in the case of the central angle $\theta_1$=0°, a flat roll was used as the rolling roll 4. Further, the angle α ($\theta_1$+90°) of the V-shaped groove 14*a* of each guide roller 14 was set to 90°, 102°, 105° and 108°, respectively.

The central angle $\theta_2$ of the perfect circle forming section 5*a* of each rolling roll 5 in the second path was set to a constant angle of 30°, and the central angle $\theta_3$ of the perfect circle forming section 6*a* of each rolling roll 6 in the third path was set to a constant angle of 45°. Used as the workpiece 7 to be introduced to the first path was an approximately circular wire which was rolled by a plurality of 2-roll rolling mills installed in series prior to the first path along the same path line as the first path.

Figure 4:
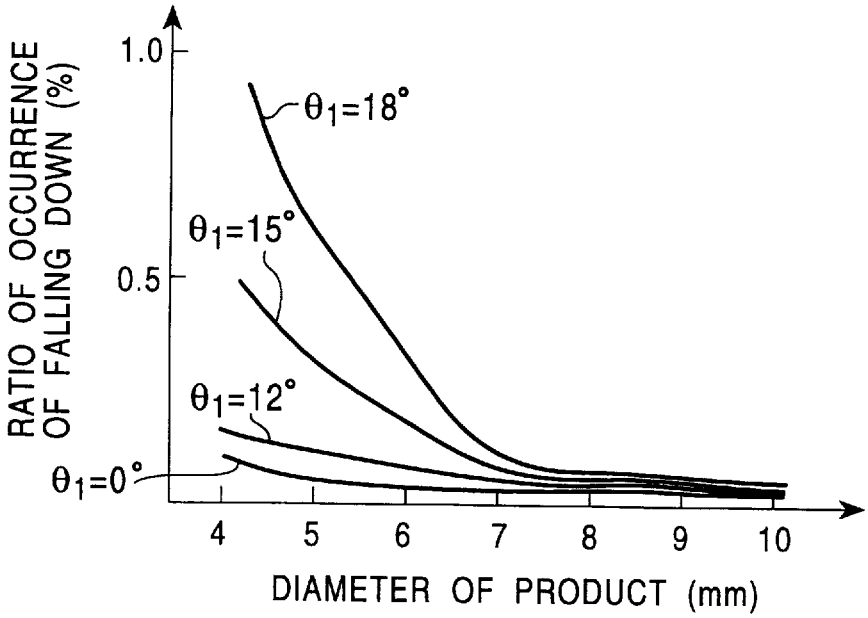
FIG. 4 is a graph by which a relationship between a diameter of a product and a ratio of occurrence of falling-down in a second path is examined by the method of the embodiment.
Figure 5:
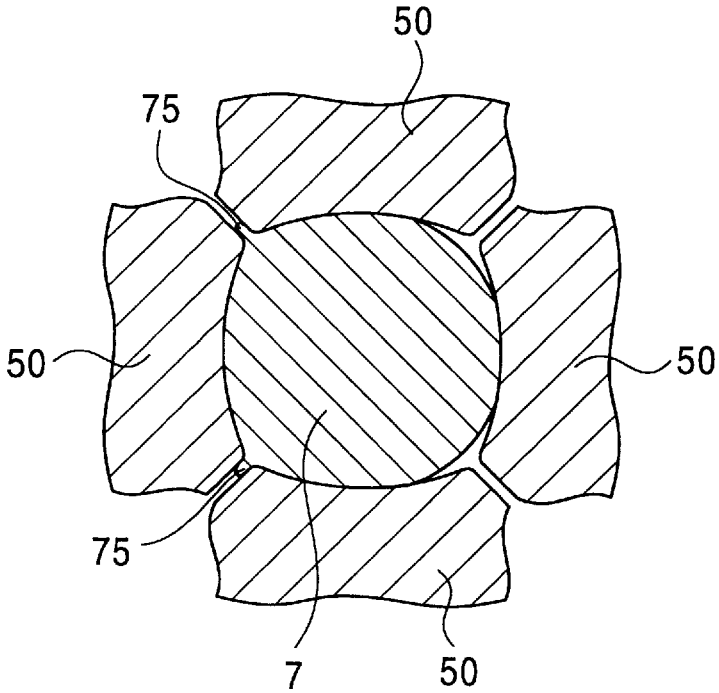
FIG. 5 is a view explaining bitten-out which is a problem in a conventional method.
Figure 6:
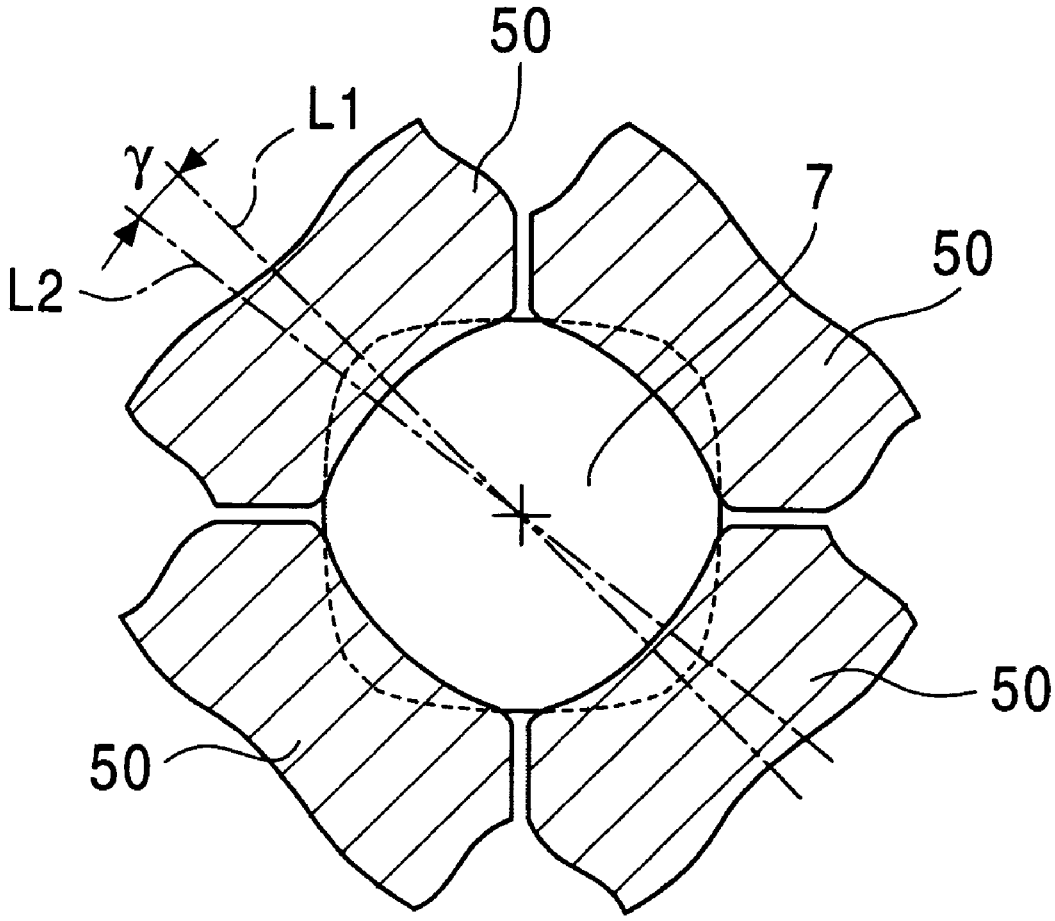
FIG 6 is a view explaining which is a problem in the conventional method.

Further, the ratio of occurrence of falling-down was calculated by determining at least 5° of a falling-down angle γ shown in FIG. 6 as "occurrence of falling-down". The result of the examination is shown in the graph of FIG. 4.

As can be seen from the graph, when the product has a diameter of 7 mm or less, the ratio of occurrence of falling-down in the second path can be reduced by setting the central angle γ of the perfect circle forming section 4*a* of each rolling roll in the first path to less than 15°. In particular, it can be found that the effect is increased when the central angle $\theta_1$ is 12° or less.

Therefore, an excellent surface property can be obtained in a resulting product by using the above-mentioned rolling mill and setting the central angle $\theta_1$ of the perfect circle forming section 4*a* of each rolling roll 4 in the first path to less than 15°, the angle α of the V-shaped groove 14*a* of each guide roller 14 to less than 105° in correspondence to the central angle $\theta_1$, the central angle $\theta_2$ of the perfect circle forming section 5*a* of each rolling roll 5 in the second path to 30°, and the central angle $\theta_3$ of the perfect circle forming section 6*a* of each rolling roll 6 in the third path to 45°.

Further, when a smaller central angle is set to the perfect circle forming section constituting the groove of each rolling roll, the size free range can be increased in the sizing rolling. Thus, the free size range can be increased by setting the central angle $\theta_1$ of the perfect circle forming section 4*a* of each rolling roll 4 in the first path to less than 15° as compared with a case in which the central angle $\theta_1$ is set to 15° or more.

Note that while the free surface 71 of the workpiece 7 is held and guided by the two sets of the guide rollers 14 as the roller guide in the embodiment, the free surface of the workpiece 7 may be held and guided by one set of two guide rollers.

Further, while the 3 sets of the 4-roll rolling mills are used and the rolling directions of the adjacent 4-roll rolling mills are inclined 45° each other in the embodiment, the method of the present invention is not limited thereto. When the rolling directions of a plurality of sets of 4-roll rolling mills are inclined 45° each other, the portion of the workpiece which was not rolled in the previous path is mainly rolled and a difference of the diameter of a resulting wire can be reduced. Thus, it is preferable also in the method of the present invention that the rolling directions of at least the 3 sets of the 4-roll rolling mills installed be inclined 45° as in the embodiment.

Further, while the 3 sets of the 4-roll rolling mills are used in the embodiment, the method of the present invention is not limited thereto and at least 4 sets of the 4-roll rolling mills may be used. In this case, the central angle and the like of the perfect circle forming section of each roll of the 4-roll rolling mill in final three paths are set in accordance with the method of the present invention and those of the 4-roll rolling mills upstream of the final three paths may be suitably set.

As described above, according to the method of the present invention, in the sizing rolling method, which is carried out by installing at least 3 sets of the 4-roll rolling mills in series, an excellent surface property can be obtained while securing a large size free range even if a wire has a diameter of 7.0 mm or less.

What is claimed is:

1. A wire sizing rolling method, characterized by comprising the steps of:

installing at least 3 sets of 4-roll rolling mills in series with each rolling mill having 2 pairs of 4 rolling rolls each having a groove formed on an outer circumferential surface and composed of an arc-shaped perfect circle forming section and escape sections and setting central angles of the perfect circle forming sections of the rolling rolls to less than 15° in the first path of final three paths, to at least 30° in the second path thereof, and to at least 45° in the third path thereof; and installing a roller guide on the inlet side of the second path and introducing a workpiece to the second path while holding and guiding the workpiece by the guide rollers of the roller guide such that the surface of the workpiece which was not rolled in the first path is located at the central portions of the guide rollers.

2. A wire sizing rolling method according to claim 1, characterized in that the escape section of each rolling roll in the first path is formed by straight lines, the straight lines act as tangential lines to both the ends of the arc forming the perfect circle forming section, a V-shaped groove for holding and guiding the workpiece is formed on the outer circumferential surface of each guide roller of the roller guide installed on the inlet side of the second path, and an angle of the V-shaped groove is set similar to the angle between the straight lines forming an escape section between the adjacent rolling rolls in the first path.

3. A wire sizing rolling method of sizing rolling a wire by a 4-roll rolling mill each having two pairs of 4 rolling rolls, characterized by comprising the steps of:

installing at least 3 sets of the 4-roll rolling mills in series, using flat rolls as rolling rolls each having an outer circumferential surface on which no groove is formed in the first path of final three paths, and using rolls as rolling rolls each having an outer circumferential surface having a groove composed of an arc-shaped perfect circle forming section and escape sections in the second and subsequent paths thereof with the central angles of the perfect circle forming sections of the respective rolling rolls set to at least 30° in the second path and to at least 45° in the third path; and installing a roller guide on the inlet side of the second path and introducing a workpiece to the second path while holding and guiding the workpiece by the guide rollers of the roller guide such that the surface of the workpiece which was not rolled in the first path is located at the central portions of the guide rollers.

4. A wire sizing rolling method according to claim 3, characterized in that a V-shaped groove for holding and guiding the workpiece is formed on the outer circumferential surface of each guide roller of the roller guide installed on the inlet side of the second path, and an angle of the V-shaped groove is set to 90°.

5. A wire sizing mill including a 4-roll rolling mill and a roller guide, wherein the 4-roll rolling mill has 2 pair of 4 rolling rolls each having a groove formed on an outer circumferential surface and composed of an arc-shaped perfect circle forming section and escape sections, at least 3 sets of the 4-roll rolling mills are installed in series, central angles of the perfect circle forming sections of the rolling rolls are set to less than 15° in the first path of final three paths, to at least 30° in the second path thereof, and to at least 45° in the third path thereof, and wherein the roller guide is installed on the inlet side of the second pat, a V-shaped groove for holding and guiding a workpiece is formed on the outer circumferential surface of each guide roller of the roller guide, and an angle of the V-shaped groove is set similar to the angle between the straight lines forming an escape section between the adjacent rolling rolls in the first path.

6. A wire sizing mill including a 4-roll rolling mill and a roller guide, wherein at least 3 sets of the 4-roll rolling mills are installed in series, flat rolls are used as rolling rolls each having an outer circumferential surface on which no groove is formed in the first path of final three paths, rolls are used as rolling rolls each having an outer circumferential surface having a groove composed of an arc-shaped perfect circle forming section and escape sections in the second and subsequent paths thereof with the central angles of the perfect circle forming sections of the respective rolling rolls set to at least 30° in the second path and to at least 45° in the third path, and wherein the roller guide is installed on the inlet side of the second path, a V-shaped groove for holding and guiding a workpiece is formed on the outer circumferential surface of each guide roller of the roller guide, and an angle of the V-shaped groove is set to 90°.

* * * * *

UNITED STATES PATENT AND TRADEMARK OFFICE

CERTIFICATE OF CORRECTION

PATENT NO. : 6,442,989 B1
DATED : September 3, 2002
INVENTOR(S) : Takeda et al.

It is certified that error appears in the above-identified patent and that said Letters Patent is hereby corrected as shown below:

Column 3,
Line 56, please insert -- 4 -- before "rolling";
Line 57, please insert -- 5 -- before "rolling";
Line 59, please insert -- 4a, -- before "5a"; and
Line 60, please insert -- 4b, -- before "5b".

Column 5,
Line 12, after "angle" please change "a" to -- $\alpha$ --, and
Line 21, after "angle" please insert -- $\alpha$ --.

Column 6,
Line 2, after "angle" please change "$\gamma$" to -- $\theta_1$ --

Signed and Sealed this

Fourth Day of February, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,442,989 B1
DATED : September 3, 2002
INVENTOR(S) : Takeda et al.

It is certified that error appears in the above-identified patent and that said Letters Patent is hereby corrected as shown below:

Column 3,
Line 58, please insert -- 6 -- before "rolling".

Signed and Sealed this

Twenty-ninth Day of July, 2003

JAMES E. ROGAN
*Director of the United States Patent and Trademark Office*